US007987887B2

(12) United States Patent
Khor et al.

(10) Patent No.: US 7,987,887 B2
(45) Date of Patent: Aug. 2, 2011

(54) RETRACTABLE CORRECTION TAPE DISPENSER

(75) Inventors: Hong Kiat Khor, Penang (MY); Chin Cheng Quah, Penang (MY); Ee Kah Teoh, Penang (MY)

(73) Assignee: Widetech Manufacturing SDN. BHD., Beyan Lepas, Penang (MY)

( * ) Notice: Subject to any disclaimer, the term of this patent is extended or adjusted under 35 U.S.C. 154(b) by 198 days.

(21) Appl. No.: 12/388,153

(22) Filed: Feb. 18, 2009

(65) Prior Publication Data

US 2009/0223636 A1 Sep. 10, 2009

(30) Foreign Application Priority Data

Mar. 4, 2008 (MY) ..... PI 20080490

(51) Int. Cl.
*B28B 19/00* (2006.01)

(52) U.S. Cl. ..... 156/577; 156/574

(58) Field of Classification Search ..... 156/577, 156/574; 118/76, 200
See application file for complete search history.

(56) References Cited

U.S. PATENT DOCUMENTS

| | | | | |
|---|---|---|---|---|
| 5,346,580 | A * | 9/1994 | Elges et al. | 156/540 |
| 5,512,128 | A * | 4/1996 | Manusch et al. | 156/577 |
| 5,679,156 | A * | 10/1997 | Matsumaru | 118/200 |
| 6,550,518 | B1 * | 4/2003 | Lee | 156/577 |
| 6,554,045 | B1 * | 4/2003 | Lee | 156/577 |
| 6,732,782 | B2 * | 5/2004 | Rollion | 156/577 |
| 6,951,431 | B2 * | 10/2005 | Rollion | 401/117 |
| 7,654,297 | B2 * | 2/2010 | Wu | 156/577 |
| 2006/0266480 | A1 * | 11/2006 | Murakoshi | 156/577 |
| 2007/0113987 | A1 * | 5/2007 | Ushijima | 156/577 |
| 2009/0229763 | A1 * | 9/2009 | Lin | 156/577 |

FOREIGN PATENT DOCUMENTS

WO WO 9962807 A1 * 12/1999

* cited by examiner

*Primary Examiner* — Khanh Nguyen
*Assistant Examiner* — John Blades
(74) *Attorney, Agent, or Firm* — Nixon Peabody, LLP; Jeffrey L. Costellia

(57) ABSTRACT

The present invention relates to a retractable correction tape-dispensing device (100). The device (100) generally comprises a housing; a supply spool (10), rotatably mounted on a supply spool spindle, for reeling the transfer tape (20) adhered with the film; a take-up spool (30), rotatably mounted on a take-up spool spindle for reeling the transfer tape (20) which has been blank-backed of the applied film; an application tip (40) displaceable between an application position and a retracted position, and the transfer tape (20) is spanned over the application tip (40); an actuating member (50), connected to the application tip (40), and manually operable to displace the application tip (40) back and forth between the application position and the retracted position; and means to propel the applicator tip into the retracted position. The device (100), to prevent the transfer tape (20) from being loosened, essentially comprises an applicator assembly (60) displaceable between the application position and the retracted position by the actuating member (50), a pair of tape tensioning arms (70) each extended from the corresponding sidewall (62) of the applicator assembly (60); and a pair of tape tensioning shafts (80) mounted on the housing.

28 Claims, 4 Drawing Sheets

RETRACTABLE CORRECTION TAPE DISPENSER

FIELD OF THE INVENTION

The present invention relates in general to a retractable correction tape dispenser.

BACKGROUND OF THE INVENTION

It is common nowadays to erase a written error using a correction pen or a correction tape-dispensing device. However, over the years, the correction tape-dispensing device has slowly gained higher sales than the correction pen. One could attribute such an outcome to certain disadvantages of the correction pen. As one uses the correction pen, the correction liquid would normally be dispensed to overlap the written error on the paper. Despite that the error can be erased by the liquid, the correction portion tends to dry up slowly and an uneven surface is often created from the dried patch of correction liquid that is entirely not desirable for writing on.

This drawback of the correction pen has led to the user favoring the correction tape dispenser. The manufacturers strive to enhance the features on the devices and have improved these correction tape-dispensing devices, leading to the creation of the retractable correction tape dispenser. These improved devices, which have a retractable applicator tip, were conceived to protect the tape by retracting the tip when the device is not in use.

Despite that, the improved devices still fail to eliminate certain setbacks. In order for the device to be operable, the device must have a lot of parts, which are held together to a number of chassis. Especially for the refillable correction tape dispenser, the parts would easily tear after some time of use. Furthermore, a device that comprises many parts is cumbersome.

In addition, in the correction tape-dispensing device with a retractable tip, the tape therein tends to be easily loosened or misaligned. The loosening of the tape loop would disrupt the guidance of the tape, resulting in inconvenience and unfriendliness in handling the device. Although the clutch to tighten any loosened tape is provided, it is still deemed inconvenient, as the user has to resort to frequent tightening of the clutch. Therefore, an improved retractable correction tape-dispensing device, which is capable of preventing the tape therein from loosening and that comprises fewer parts, is very much needed.

SUMMARY OF THE INVENTION

Accordingly, to solve the disadvantages and drawbacks of the prior art, there is provided a retractable correction tape dispensing device for application of a film from a transfer tape, and said device is conceived to comprise a mechanism that is capable to prevent the transfer tape from being loose and misaligned.

The retractable correction tape dispensing device is generally comprised of a housing; a supply spool rotatably mounted on a supply spool spindle for reeling the transfer tape having applicable film adhered thereto; a take-up spool rotatably mounted on a take-up spool spindle for reeling the transfer tape which has been blank-backed of the applied film; an applicator tip which is displaceable between an application position and a retracted position; an actuating member connected to the application tip and manually operable for displacing the application tip back and fork between the application position and the retracted position, and means to retract the applicator tip from the application position to the retracted position. The application tip is disposed at the proximal end of the housing and is extendable through an opening formed at the proximal end of the housing. The transfer tape is spanned over the application tip and the film is then applied to a substrate therefrom.

Said retractable correction tape dispensing device of the present invention is enhanced with certain features to achieve the desired result of preventing the transfer tape from being loosened or misaligned. To achieve this result, said device further comprises means to hold the transfer tape taut by maintaining a tension of the length of the transfer tape forming the said circuit between a lower and a higher value during the extension and retraction of the application tip. The lower value is the point below which the length of the transfer tape forming said circuit can no longer effect smooth rotation of the circuit, and the higher value is a point above which the transfer tape is damaged or snaps. The means initiates a folding of the transfer tape widthwise in at least two places when the application tip is in the retracted position and also initiates an unfolding the transfer tape widthwise at said at least two places when the application tip is in the application position.

The folding initiated widthwise on a portion of the transfer tape in said retracted position is achieved by a tape tensioning arm and a tape-tensioning shaft. The tip of the arm positioned more distal in relation to a corresponding tape tensioning shaft. The tape is initiated with the folding at two places, which are at the tip of the arm and at the shaft.

The device of the present invention may comprise a plurality of tape tensioning arms and a plurality of tape tensioning shafts.

It is therefore an object of the present invention to provide a mechanism that is operated to prevent the transfer tape from being loosened and misaligned in the application position and the retracted position, or even during tape rotation in the application stage.

It is another object of the present invention to improve the guidance of the transfer tape before and after the applicator tip in such a manner that the transfer tape remains held taut therewith.

It is a further object of the present invention to improve the flow of the transfer tape from the supply spool and also the flow of the transfer tape to the take-up spool so that no jamming or loosening would occur around the spools.

It is also an object of the present invention to provide a functional retractable correction tape-dispensing device which is capable of preventing any loose being formed on the transfer tape, and which employs fewer components, as compared to the conventional retractable correction tape-dispensing device.

It is a final object of the present invention to provide a retractable correction tape-dispensing device that allows the film strip of the tape to always start at the edge of the applicator tip (40) rather than being dislocated too advanced or receded from the tip position.

The present invention consists of certain novel features and a combination of parts hereafter fully described and illustrated in the accompanying drawings and particularly pointed out in the appended claims; it being understood that various changes in the details may be without departing from the scope of the invention or sacrificing any of the advantages of the present invention.

BRIEF DESCRIPTION OF THE DRAWINGS

For the purpose of facilitating an understanding of the invention, there is illustrated in the accompanying drawings the preferred embodiments from an inspection of which when considered in connection with the following description, the invention, its construction and operation and many of its advantages would be readily understood and appreciated.

DETAILED DESCRIPTION OF THE PREFERRED EMBODIMENTS

Figure 1:
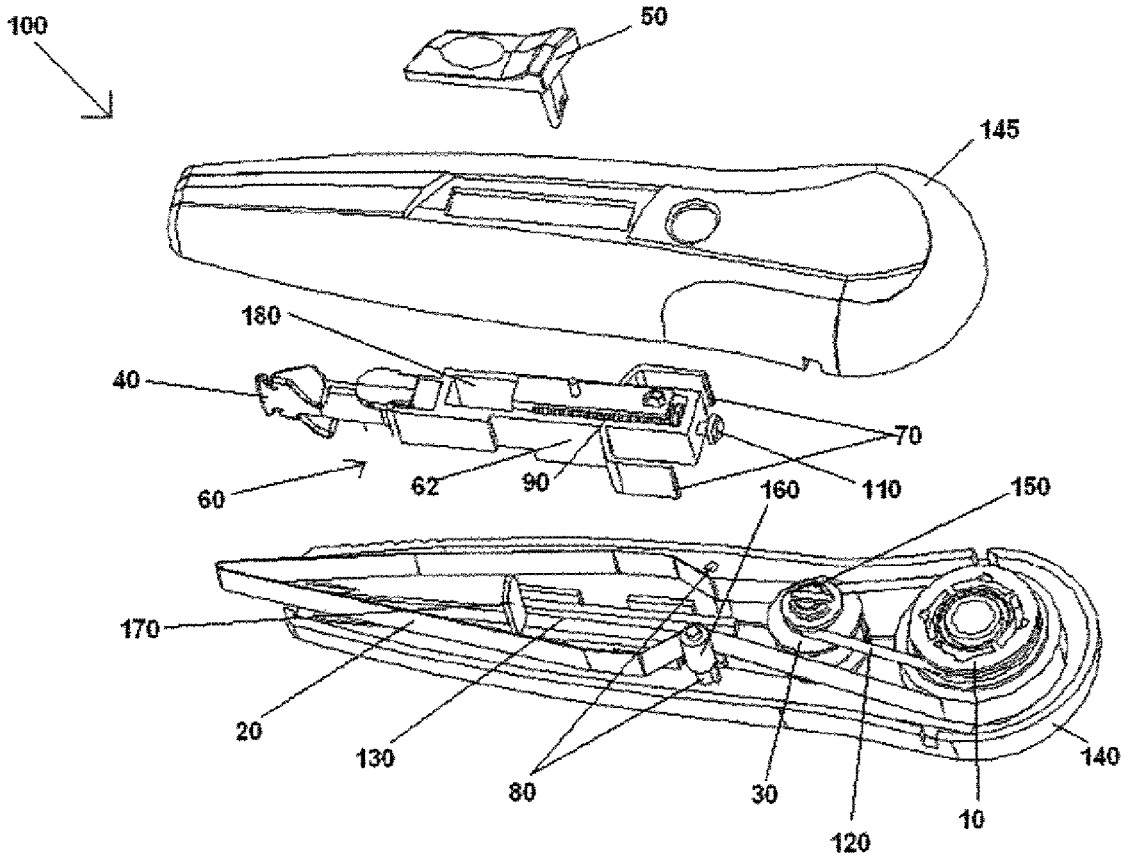
FIG. 1 is an exploded perspective view showing a retractable correction tape dispensing device divided in four separated parts, and the separated parts are the actuating member, the cover member, the applicator assembly, and the base member.

The present invention relates to a retractable correction tape-dispensing device. More particularly, the present invention relates to a retractable correction tape-dispensing device (100), which is further provided with a mechanism that is capable of preventing the transfer tape (20) from becoming loosened and misaligned. Hereinafter, the retractable correction tape-dispensing device (100) shall be described according to the preferred embodiments of the present invention and by referring to the accompanying description and drawings. However, it is to be understood that limiting the description to the preferred embodiments of the invention and to the drawings is merely to facilitate discussion of the present invention and it is envisioned that those skilled in the art may devise various modifications without departing from the scope of the appended claim.

The present invention relates to a device (100) for application of a film from a transfer tape (100). The device may comprise a housing, at least one spool (10 & 30) for reeling the transfer tape (20) adhered with the film and the transfer tape (20) which has been blank backed of the applied film, an application tip (40) displaceable between an extended position and a retracted position, the application tip (40) is disposed at the proximal end of the housing, the transfer tape (20) is spanned over the application tip (40) such that a length of the transfer tape (20) forms a circuit between said at least one spool (10 & 30) and applicator tip (40), an actuating member (50) connected to the application tip (40), and means to hold the transfer tape taut by maintaining a tension of the length of transfer tape (20) forming said circuit between a lower and a higher value during the extension and retraction of the application tip (40).

Said lower value is a point below which the length of the transfer tape (20) forming said circuit can no longer effect smooth rotation of the circuit, whereas the higher value is a point above which the transfer tape (20) is damaged or snaps. A folding may be initiated widthwise on the transfer tape (20) in at least two places when the application tip (40) is in the retracted position. The means to hold the transfer tape taut may also initiate an unfolding of the transfer tape (20) widthwise at said at least two places when the application tip (40) is in said extended position. The actuating member (50) of the present invention is manually operable to displace the application tip (40) back and forth between the extended position and the retracted position.

When the application tip (40) is in said retracted position, the folding is initiated by a tape tensioning arm (70). The tip of the arm (70) is in a position more distal in relation to a corresponding tape tensioning shaft (80) such that the tape (20) is initiated with said folding at the tip of the arm (70) and at the shaft (80). A zigzag configuration is formed at the portion of the tape (20) at the tip of the arm (70) and at the shaft (80).

The present invention also relates to a system for holding a transfer tape taut by maintaining the tension of the transfer tape in a tape dispenser with an application tip (40) that is extendable and retractable with respect to the dispenser during both an extension and a retraction phase, between a lower value and a higher value. The lower value is a point below which the length of the transfer tape (20) forming a circuit spanning the application tip (40) and can no longer provide for smooth rotation of the circuit, whilst the higher value being a point above which the tape (20) is damaged or snaps. The system comprises a tape tensioning shaft (80) fixed in relation to the dispenser, and a tape-tensioning arm (70) fixed in relation to the displaceable application tip (40).

The tape-tensioning arm (70) may be positioned such that the tip of the arm (70) and the shaft (80) are located on opposing sides of a portion of the tape (20). As the application tip (40) is retracted into the dispenser, the tip of the arm (70) contacts a point in said circuit and moves said point along a path that passes close to the shaft (80) such that a folding is initiated widthwise on the tape (20) at the tip of the arm (70) and at the shaft (80). The portion of the tape (20) at the tip of the arm (70) and at the shaft (80) forms a zigzag configuration.

The means to hold the transfer tape taut may preferably comprise at least one couple of a tape tensioning arm (70) and a corresponding tape tensioning shaft (80) for initiating said folding of the tape (20) widthwise to form at least one of said zigzag configuration.

Referring to FIG. 1, the retractable correction tape-dispensing device (100) is shown. The retractable correction tape dispensing device (100) according to the most preferred embodiment of the present invention, comprises a housing having a cover member (145) and a base member (140); a supply spool (10) rotatably mounted on a supply spool spindle formed on the housing; a take-up spool (30) rotatably mounted on a take-up spool spindle; an applicator tip (40) which is displaceable between an application position and a retracted position; and an actuating member (50) which is manually operable for displacing the application tip (40) back and forth between the application position and the retracted position. The application tip (40) as shown is disposed at the proximal end of the housing and is operated by a user via the actuating member (50). The transfer tape (20) is spanned over the application tip (40) and the film is applied to the substrate therefrom.

Still referring to the FIG. 1, the supply spool (10) reels the transfer tape having film adhered thereto whereas the take-up spool (30) reels the transfer tape which has been blank-backed of the applied film.

Apart from the above components, the device (100) also further comprises an applicator assembly (60), a pair of tape-tensioning arms (70) and a pair tape tensioning shafts (80). Said components, which play a vital role in preventing the transfer tape (20) from being loosened, will be hereinafter described in greater detail. The application assembly (60) at the top is connected with the actuating member (50) that displaces the applicator tip (40). The application assembly (60), in which the applicator tip (40) is mounted at the proximal end thereof, is also displaceable between the application position and the retracted position. Said displacement is manipulated by a user via the actuating member (50). User is only required to push the actuating member (50), which may be in the form of a pushbutton (50), in a proximal direction to enable the applicator tip (40) to be extended out through the mouth of the housing for the application. To retract the tip (40), the user has to release the pushbutton (50) and the mechanism within the application assembly (60) would retract the tip (40) automatically.

The need of the applicator assembly (60) to transverse smoothly back and forth between the application position and the retracted position is met by the provision of a guide rail (130) formed substantially at the intermediate section of the base member (140). Projections (not shown) underneath the assembly (60) are provided to be slidably engaged with the guide rail (130) for smoother traversing movement and better gasping.

In the preferred embodiment, the application assembly (60) is displaced back to the retracted position automatically with an operation of a mechanism. The application assembly (60) further comprises a bracket (180) to accommodate a spring (90), which is functioned to automatically bias the assembly (60) to the retracted position. The base member (140) therefore further comprises a stopper (170) formed at the proximal end of the guide rail (130) as illustrated in FIG. 1. In order for the mechanism to operate, the spring (90) is received in the bracket (180) with the proximal end of the spring (90) is connected to the stopper (170), whilst the distal end of the spring (90) is connected to the distal end of the bracket (180). In operation, a user pushes the pushbutton (50) in the proximal direction, resulting the applicator assembly (60) being pushed proximally from the retracted position to the application position, the spring (90) would then be compressed against the stopper (170); and once the pushbutton (50) is released from the manual force, the spring (90) would decompress and subsequently bias the applicator assembly (60) to the retracted position.

Figure 2:
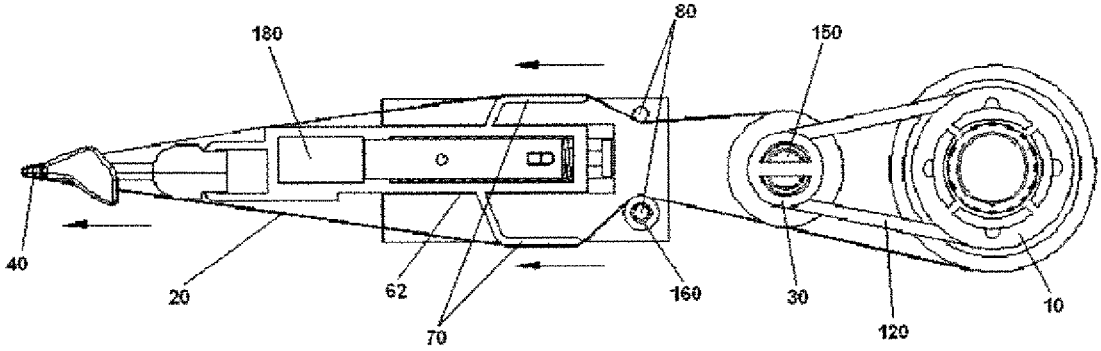
FIG. 2 is a top view of the retractable correction tape-dispensing device wherein the applicator assembly is displaced to the application position by pushing the actuating member in the proximal direction.
Figure 4:
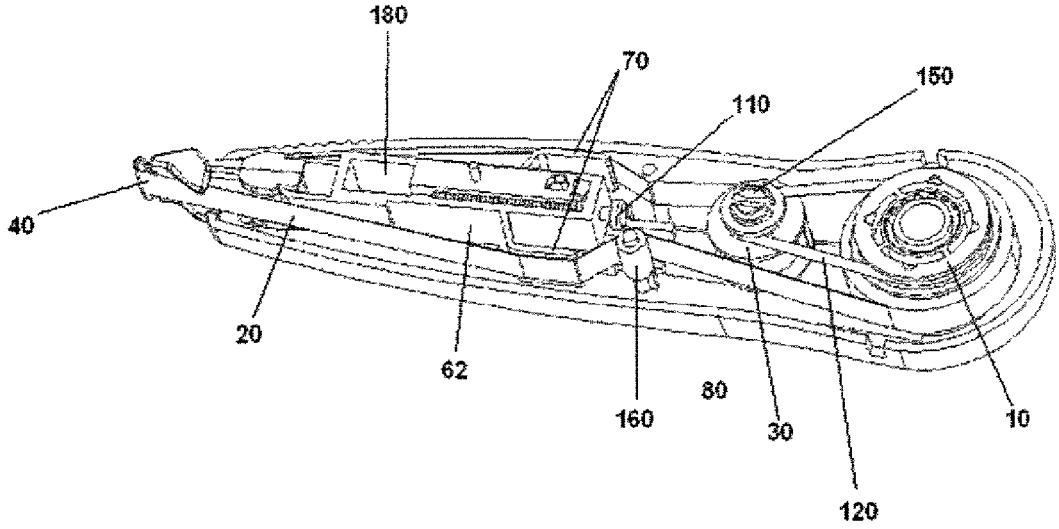
FIG. 4 is a perspective view of the retractable correction tape-dispensing device in which the applicator assembly is displaced to the application position.

Referring still to FIG. 1, in the preferred embodiment, at either one side of the applicator assembly (60), the transfer tape (20) is spanned in the proximal direction from the supply spool to the deflection at the corresponding tape tensioning shaft (80). The transfer tape (20) would then be deflected at the tape-tensioning arm (70) to provide firmer deflection The transfer tape (20) with the adhered film would wind around the applicator tip (40) and the transfer tape (20) would dispense the film as the film is applied on the substrate. On the other side of the applicator assembly (60), the transfer tape would travel in the distal direction from the applicator tip (40). The tape-tensioning arm (70) would firstly deflect the transfer tape (20) and then followed by deflection at the tape-tensioning shaft (80) as illustrated in FIGS. 2 and 4.

Figure 3:
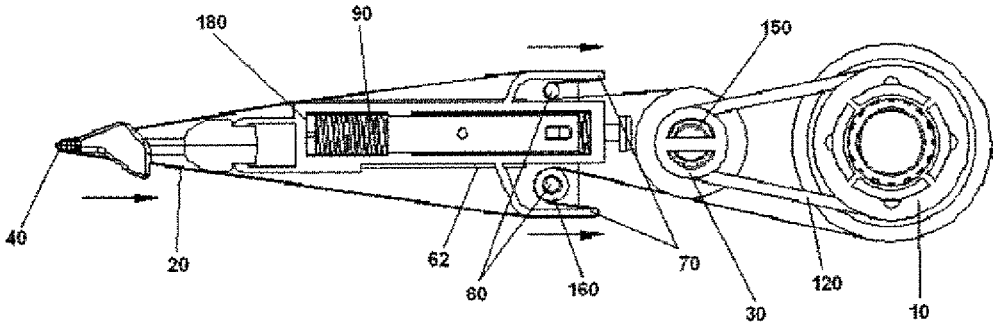
FIG. 3 is top view of the retractable correction tape-dispensing device wherein the applicator assembly is displaced to the retracted position by the biasing force implemented by the decompression of the spring when the actuating member is released from the manual force.
Figure 5:
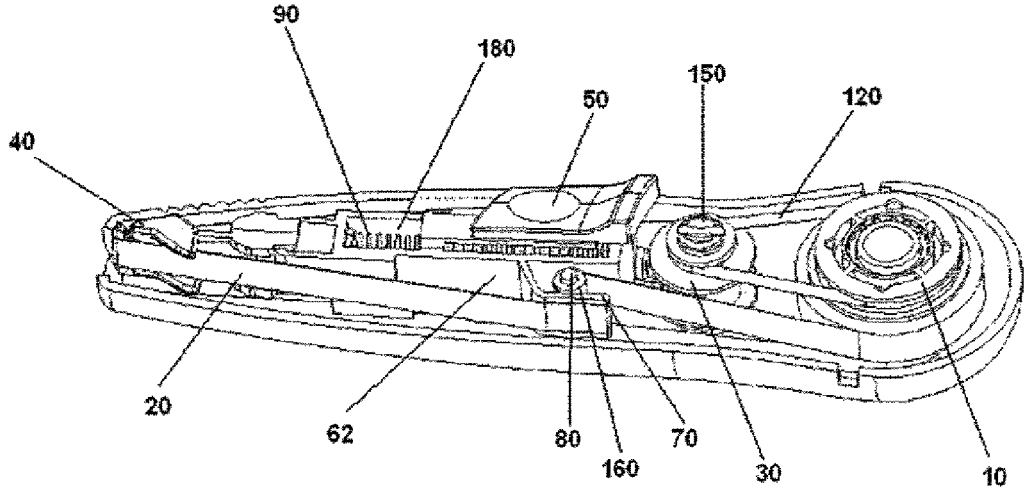
FIG. 5 is a perspective view of the retractable correction tape-dispensing device in which the applicator assembly is displaced to the retracted position.

Referring now to FIGS. 3 and 5, as illustrated, the arms (70) are displaced into a position nearer to the shafts (80) when the applicator assembly (60) is retracted. The transfer tape (20) in the retracted position is seen being wound around the shafts (80) and the arms (70). The winding of the transfer tape (20) around the shaft (80) still retains the tape in firm deflection and it conveniently saves some length of tape in the winding state to be used when the tape (20) is stretched as the arms (70) are pulled away from the shafts (80) in the application position later as illustrated in FIGS. 2 and 4.

Figure 6:
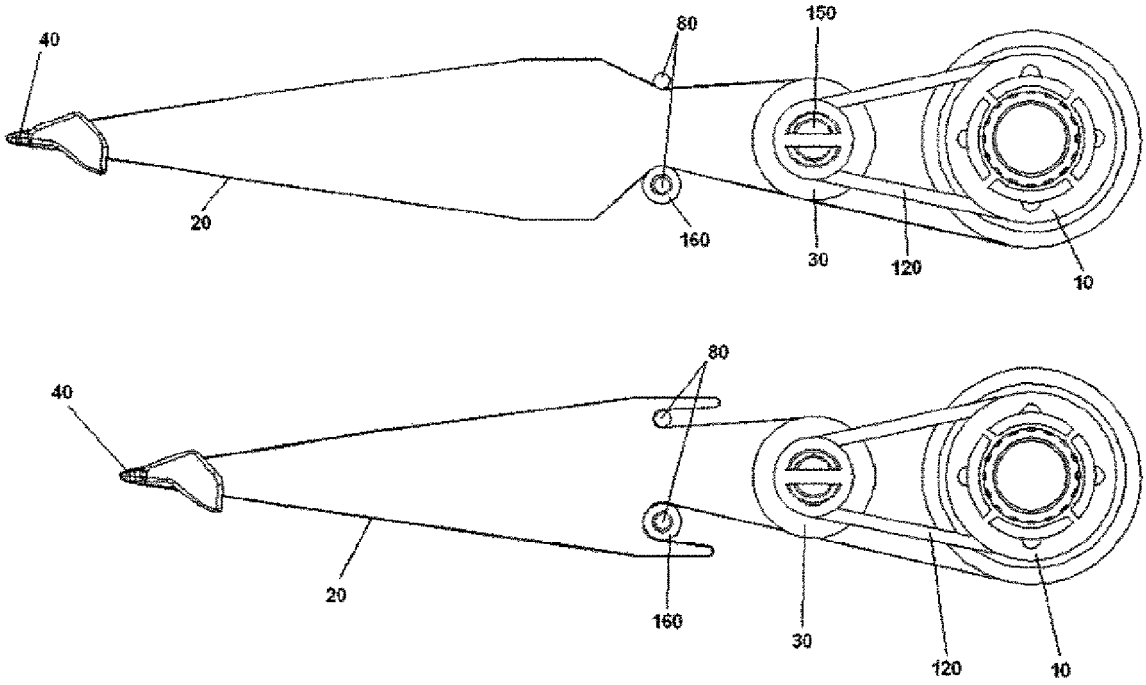
FIG. 6 is a top view showing the guidance trail of the transfer tape when the application assembly is in the application position and when the application assembly is in the retracted position.

As illustrated in FIGS. 3 and 5, when the actuating member (50) is being pushed in the proximal direction, the applicator assembly (60) would be displaced proximally to the application position. The arms (70) would he caused to move further from the shafts (80) as a result of the movement. The saved length of tape (20) which has been wound around the arms (70) and the shafts (80) would be extended to mutually span from the deflection at the shafts (80) to the lengthwise extent of the arms (70). The FIG. 6 shows the guidance trail of the transfer tape (20) in both the application and the retracted positions. It is shown therein that the length of the tape in the maximized deflection when the application assembly (60) is in the application position is capably balanced with the length of the tape (20), in the winding state around the arms (70) and the shafts (80), when said assembly (60) is in the retracted position. The mechanism described herein therefore prevents any loosening of the transfer tape (20) around the deflections, the spools (10 & 30) and also the applicator tip (40), even during the tape (20) rotation.

Referring back to FIG. 1, according to a preferred embodiment, the tape tensioning shaft (80), that deflects the transfer tape with the film adhered therewith, may comprise a roller (160). The roller rotatably mounted on the corresponding tape-tensioning shaft (80) functions as a comforter to said transfer tape (20). Furthermore, the film adhered to the transfer tape (20) if without the roller would always be touching the shaft (80) resulting the film being scratched off from the tape (20) during the tape rotation.

A boss (110) may be formed at the distal end thereof for stopping the applicator assembly (60) from further sliding in the distal direction when the applicator assembly (60) is in the retracted position such that the boss (110) is stopped by the corresponding spool (30).

Furthermore, the supply spool (10) and the take-up spool (30) are operatively interconnected via a loop (120). The loop (120) conveniently allows both spools (10 & 30) to rotate mutually in order to control the tension of the tape (20).

The take-up spool spindle may also be provided with an adjusting clutch (150) operatively connected to the loop (120). A user may conveniently tighten any possible slack that occurred in the tape spooling by the adjusting clutch (150) which is extended through an aperture on the cover member (145).

It is also preferred that the tape-tensioning arms (70) each are extended from the corresponding sidewall (62) of the applicator assembly (60) in the distal direction so that when the applicator assembly (60) is retracted, according to the FIGS. 2 and 6, the transfer tape (20) would wrap tightly around the corresponding shaft (80) and the corresponding arm (70) as illustrated.

Referring again to FIG. 1, the tape tensioning shafts (80) may be formed on the base member (140). As illustrated in FIG. 1, according to the preferred embodiment, a first couple of tape tensioning arm (70) and shaft (80) is located at one side of the applicator assembly (60). A second couple of tape tensioning arm (70) and shaft (80) in a mirror image of said first couple, is located on an opposite side of the housing. The two tape tensioning arms (70) located at both side of the applicator assembly (60) ensure that the tape would not be misaligned when the applicator tip (40) is traversed between the extended position and the retracted position. This disposition of arms (70) allows the film strip of the tape (20) to always start at the edge of the applicator tip (40) rather than being dislocated too forward or reverse from the tip position. If the device (100) only has one sided arm (70), said problem of misaligned tape (20) in which the tape (20) could start at an advanced position from the tip (40) or receded from the tip (40), may more likely persist.

While in the foregoing specification this invention has been described in relation to certain preferred embodiments thereof and many details have been set forth for purpose of illustration, it will be apparent to those skilled in the art that the invention is susceptible to additional embodiments and that certain of the details described herein can be varied considerably without departing from the basic principles of the invention.

The invention claimed is:

1. A retractable correction tape-dispensing device (100) comprising:

a housing;

a supply spool (10) configured to wind a first portion of a transfer tape (20) that is adhered with a film;

a take-up spool (30) configured to wind a second portion of the transfer tape (20) that is not adhered with the film;

an applicator assembly (60) movable back and forth between an application position and a retracted position according to a position of an actuating member (50), the applicator assembly (60) comprising:

an application tip (40) disposed at a distal end of the housing and a distal end of the applicator assembly (60), the application tip (40) having the transfer tape (20) wrapped thereon;

first and second sidewalls (62); and first and second tape tensioning arms (70) extending from the first and second sidewalls (62), respectively;

a retracting mechanism configured to move applicator assembly (60) into the retracted position; and first and second tape tensioning shafts (80) mounted on the housing, wherein the first tape tensioning shaft (80) and the first tape tensioning arm (70) engage the first portion of the transfer tape (20), wherein the second tape tensioning shaft (80) and the second tape tensioning arm (70) engage the second portion of the transfer tape (20), wherein the first and second tape tensioning arms (70) cover the first and second tape tensioning shafts (80) when the applicator assembly (60) is in the retracted position, thereby wrapping the transfer tape (20) around the first and second tape tensioning arms (70) and the first and second tape tensioning shafts (80), and wherein the first and second tape tensioning arms (70) expose the first and second tape tensioning shafts (80) when the applicator assembly (60) is in the application position, thereby pulling the transfer tape (20) taut between the first and second tape tensioning shafts (80) and the first and second tape tensioning arms (70), and thereby preventing the transfer tape (20) from being loosened and misaligned.

2. The retractable correction tape-dispensing device (100) of claim 1, wherein the first tape tensioning shaft (80) and the first tape tensioning arm (70) engage the first portion of the transfer tape (20) in a zig-zag configuration, and wherein the second tape tensioning shaft (80) and the second tape tensioning arm (70) engage the second portion of the transfer tape (20) in a zig-zag configuration.

3. The retractable correction tape-dispensing device (100) of claim 1, wherein the first tape tensioning arm (70) and the first tape tensioning shaft (80) are located symmetrically to the second tape tensioning arm (70) and the second tape tensioning shaft (80).

4. The retractable correction tape-dispensing device (100) of claim 3, wherein the first and second tape tensioning arms (70) and the first and second tape tensioning shafts (80) are configured such that the film adhered to the first portion of the transfer tape (20) starts at an edge of the application tip (40), and the film is prevented from being dislocated forward or reverse from the edge of the application tip (40).

5. The retractable correction tape-dispensing device (100) of claim 1, wherein the transfer tape (20) is looped tightly around the first and second tape tensioning arms (70) and the first and second tape tensioning shafts (80) when the applicator assembly (60) is in the retracted position, and wherein the transfer tape (20) is tensely deflected at the first and second tape tensioning arms (70) and the first and second tape tensioning shafts (80) when the applicator assembly (60) is in the application position.

6. The retractable correction tape-dispensing device (100) of claim 1, wherein the housing comprises a base member (140) and a cover member (145).

7. The retractable correction tape-dispensing device (100) of claim 6, wherein the base member (140) comprises first and second spindles disposed at a proximal end of the housing, and wherein the first and second spindles are configured to rotatably mount the supply spool (10) and the take-up spool (30), respectively.

8. The retractable correction tape-dispensing device (100) of claim 7, wherein the first tape tensioning shaft (80) comprises a roller (160) rotatably mounted thereon, and wherein the roller (160) is configured to be a comforter to the transfer tape (20) and to prevent the film from being scratched off of the first portion of the transfer tape (20).

9. The retractable correction tape-dispensing device (100) of claim 8, wherein the base member (140) further comprises a guide rail (130) and a stopper (170) mounted on the guide rail (130), wherein the guide rail (130) is configured to facilitate movement of the applicator assembly (60) back and forth between the application position and the retracted position.

10. The retractable correction tape-dispensing device (100) of claim 9, wherein the retracting mechanism is a resilient element.

11. The retractable correction tape-dispensing device (100) of claim 10, wherein the applicator assembly (60) further comprises a bracket (180) and at least one projection, and wherein the projection is slidably engaged with the guide rail (130).

12. The retractable correction tape-dispensing device (100) of claim 11, wherein the resilient element is received in the bracket (180), wherein a first end of the resilient element is connected to the stopper (170), and wherein a second end of the resilient element is connected to the bracket (180).

13. The retractable correction tape-dispensing device (100) of claim 12, wherein the actuating member (50) is connected to the applicator assembly (60), and wherein the actuating member (50) is operable to move the application tip (40) back and forth between the application position and the retracted position when manual force is applied to or released from the actuating member (50), respectively.

14. The retractable correction tape-dispensing device (100) of claim 13, wherein the resilient element is compressed against the stopper (170) when the applicator assembly (60) is moved from the retracted position to the application position toward the distal end of the housing, and wherein the resilient element is decompressed, thereby moving the applicator assembly (60) to the retracted position, when the manual force is released from the actuating member (50).

15. The retractable correction tape-dispensing device (100) of claim 14, wherein the resilient element is a spring (90).

16. The retractable correction tape-dispensing device (100) of claim 15, wherein the applicator assembly (60) further comprises a boss (110), and wherein the boss (110) is connected to the actuating member (50).

17. The retractable correction tape-dispensing device (100) of claim 16, wherein the supply spool (10) and the take-up spool (30) are operatively connected via a loop (120) to allow the supply spool (10) and the take-up spool (30) to rotate mutually, thereby controlling the tension of the transfer tape (20).

18. The retractable correction tape-dispensing device (100) of claim 15, wherein the second spindle comprises an adjusting clutch (150) operatively connected to the loop (120), and wherein the adjusting clutch (150) is accessible to a user via an opening formed through the cover member (145) to thereby enable the user to tighten any slack of the transfer tape (20).

19. The retractable correction tape-dispensing device (100) of claim 18, wherein the first and second tape tensioning arms (70) extend from the first and second sidewalls, respectively, in a distal direction, thereby looping the transfer tape (20) tightly around the tape-tensioning arms (70) and the tape-tensioning shafts (80) when the applicator assembly (60) is in the retracted position.

20. The retractable correction tape-dispensing device (100) of claim 19, wherein the first and second tape tensioning shafts (80) are formed on the base member (140).

21. The retractable correction tape-dispensing device (100) of claim 20, wherein the first tape tensioning arm (70) and the first tape tensioning shaft (80) are located symmetrically to the second tape tensioning arm (70) and the second tape tensioning shaft (80), and wherein the first and second tape tensioning arms (70) and the first and second tape tensioning shafts (80) are configured such that the film adhered to the first portion of the transfer tape (20) starts at an edge of the application tip (40), and the film is prevented from being dislocated forward or reverse from the edge of the application tip (40).

22. A retractable correction tape-dispensing device (100) comprising:

a housing;

at least one spool (10, 30) for winding at least one of a first portion of a transfer tape (20) that is adhered with a film and a second portion of the transfer tape (20) that is not adhered with the film;

an application tip (40) movable between an application position and a retracted position disposed at a distal end of the housing, the application tip (40) having the transfer tape (20) wrapped thereon to thereby interconnect the at least one spool (10, 30) and the application tip (40);

an actuating member (50) connected to the application tip (40) that is operable to move the application tip (40) back and forth between the application position and the retracted position; and means to hold the transfer tape (20) taut configured to maintain tension in the transfer tape (20) interconnecting the at least one spool (10, 30) and the application tip (40) between a first tension and a second tension, wherein the first tension is a tension below which the transfer tape (20) can no longer effect smooth rotation between the at least one spool (10, 30) and the application tip (40), wherein the second tension is a tension above which the transfer tape (20) is damaged or severed, wherein the transfer tape (20) is folded widthwise in at least two places when the application tip (40) is in the retracted position, and wherein the transfer tape (20) is unfolded widthwise in the at least two places when the application tip (40) is in the application position.

23. The retractable correction tape-dispensing device (100) of claim 22, wherein the transfer tape (20) is folded widthwise in the at least two places by a tape tensioning arm (70), wherein a tip of the tape tensioning arm (70) extends beyond a corresponding tape tensioning shaft (80) when the application tip (40) is in the retracted position, and wherein the at least two places comprise the tip of the tape tensioning arm (70) and the corresponding tape tensioning shaft (80).

24. The retractable correction tape-dispensing device (100) of claim 23, wherein the transfer tape (20) is folded widthwise in the at least two places in a zigzag configuration.

25. The retractable correction tape-dispensing device (100) of claim 23, further comprising:

at least one additional tape tensioning arm (70) and at least one additional corresponding tape tensioning shaft (80), wherein the tape tensioning arms (70) and the corresponding tape tensioning shafts (80) are comprised in the means to hold the transfer tape (20) taut, wherein the tape tensioning arm (70) and the tape tensioning shaft (80) engage the first portion of the transfer tape (20), wherein the at least one additional tape tensioning arm (70) and the at least one additional tape tensioning shaft (80) engage the second portion of the transfer tape (20), and wherein the transfer tape (20) is folded widthwise in the at least two places in at least one zigzag configuration.

26. The retractable correction tape-dispensing device (100) of claim 22, first and second tape tensioning arms (70); and first and second tape tensioning shafts (80), wherein the tape tensioning arm (70) and the tape tensioning shaft (80) engage the first portion of the transfer tape (20), wherein the at least one additional tape tensioning arm (70) and the at least one additional tape tensioning shaft (80) engage the second portion of the transfer tape (20), wherein the first tape tensioning arm (70) and the first tape tensioning shaft (80) are located symmetrically to the second tape tensioning arm (70) and the second tape tensioning shaft (80), wherein the transfer tape (20) is folded widthwise in the at least two places by at least one of the first and second tape tensioning arms (70), wherein a tip of each of the first and second tape tensioning arms (70) extends beyond the first and second tape tensioning shafts (80), respectively, when the application tip (40) is in the retracted position, and wherein the at least two places comprise the tip of at least one of the first and second tape tensioning arms (70) and at least one of the first and second tape tensioning shafts (80).

27. The retractable correction tape-dispensing device (100) of claim 26, wherein the first and second tape tensioning arms (70) and the first and second tape tensioning shafts (80) are configured such that the film adhered to the first portion of the transfer tape (20) starts at the edge of the application tip (40), and the film is prevented from being dislocated forward or reverse from an edge of the application tip (40).

28. The retractable correction tape-dispensing device (100) of claim 23, wherein the tape tensioning shaft (80) further comprises a roller (160) attached circumferentially to the tape tensioning shaft (80) that is rotatable with respect to the tape tensioning shaft (80), and wherein the roller (160) is configured to be a comforter to the transfer tape (20) and to prevent the film from being scratched off of the first portion of the transfer tape (20).

* * * * *